US005288165A

United States Patent [19]

Douwes Dekker

[11] Patent Number: 5,288,165

[45] Date of Patent: Feb. 22, 1994

[54] PROVISIONAL ROAD SURFACE

[75] Inventor: Dirk M. Douwes Dekker, Katwijk, Netherlands

[73] Assignee: Nederlandse Organisatie voor Toegepast-Natuurwetenschappelijk Onderzoek Tno, Delft, Netherlands

[21] Appl. No.: 834,668

[22] Filed: Feb. 12, 1992

[30] Foreign Application Priority Data

Feb. 12, 1991 [NL] Netherlands ..... 9100244

[51] Int. Cl.[5] ..... E01C 5/16; E01C 5/20; E01C 5/22

[52] U.S. Cl. ..... 404/35; 404/40

[58] Field of Search ..... 404/35, 36, 40, 72

[56] References Cited

U.S. PATENT DOCUMENTS

| | | | |
|---|---|---|---|
| 1,599,583 | 9/1926 | Newman . | |
| 2,653,525 | 9/1953 | McGuire | 404/35 |
| 3,509,800 | 5/1970 | Kirkamp et al. | 404/35 |
| 4,596,731 | 6/1986 | Cudmore et al. | 404/36 X |
| 5,131,787 | 7/1992 | Goldberg | 404/35 X |

FOREIGN PATENT DOCUMENTS

| | | | |
|---|---|---|---|
| 0149314 | 7/1985 | European Pat. Off. . | |
| 0286395 | 10/1988 | European Pat. Off. . | |
| 2354417 | 1/1978 | France . | |
| 401117 | 4/1966 | Switzerland . | |
| 1392174 | 4/1988 | U.S.S.R. | 404/35 |
| 562188 | 6/1944 | United Kingdom . | |

*Primary Examiner*—Stephen J. Novosad
*Attorney, Agent, or Firm*—Bachman & LaPointe

[57] ABSTRACT

A re-usable road surface, consisting of soil-repression-bodies to be placed on the provisional ground surface with a certain mutual distance and link-elements between the bodies, whereby each body is formed as a plate-shaped part with circular or multi-angular shape and therebelow a rigid repression part, the plate-shaped part being provided with means for arranging the flexible link-elements, whereby the bodies are arranged in mutually staggered rows and each body is connected with adjacent bodies in other longitudinal or transversal rows by said link-elements.

10 Claims, 5 Drawing Sheets

PROVISIONAL ROAD SURFACE

BACKGROUND OF THE INVENTION

The invention relates to a re-usable road surface, consisting of soil-repression-bodies to be placed on the ground surface with a certain mutual distance and link-elements between the bodies.

A similar provisional road surface is for example known from EP-A-0286 396, where each soil-repression body in top view has an ablong rectangular form and the bodies are arranged in one row, whereby the link-elements are arranged in two parallel longitudinal rows between the bodies. Such a provisional road surface is arranged as a roadway in two adjacent paths, so that vehicles or the like can move thereon. Thus this provisional road surface has a very restricted width.

SUMMARY OF THE INVENTION

The invention provides a provisional road surface for many applications, such as:

temporary or permanent roads on a poor terrain, which is hard going;

temporary or permanent roads on garbage-belts;

temporary or permanent roads in forestry ranges;

temporary or permanent roads in snow fields;

temporary runways for aircraft;

temporary landing areas for helicopters; and temporary or permanent pavement for stockyards for containers or equipment and temporary or permanent parking areas.

The invention is characterized in that each body is formed as a plate-shaped part with circular or multi-angular shape and therebelow a rigid repression part, the plate-shaped part being provided with means for arranging the flexible link-elements, whereby the bodies are arranged in mutually staggered rows and each body is connected with adjacent bodies in other longitudinal or transversal rows by said link-elements.

The advantages of this provisional road surface, according to the invention, are that it is light in weight; that it can be transported in folded bundles; that it has a low material use per unit area ratio and is therefore relatively cheap; that small units of the provisional road surface can easily be arranged into a complete temporary road surface with the aid of hand-tools; that the provisional road surface can easily be picked-up again (if necessary again in small units); that, covered with a thin layer of soil, the provisional road surface is excellently camouflaged; that the provisional road surface adopts itself to unevenness in the terrain, for example over rock-outcrops, tree-trunks or into small holes; that the provisional road surface can easily be adopted around obstacles in the terrain, for example around a tree, or be shaped into a narrow curb; that the provisional road surface may be used by tracked vehicles, even in curbs, provided that it is covered with a thin layer of sand; that rolled-up the provisional road surface can be used as a fascine, to bridge terrain incisions and (water-transporting) ditches.

BRIEF DESCRIPTION OF THE DRAWINGS

The invention will be explained with reference to the drawings, showing some structural and application examples.

DETAILED DESCRIPTION OF PREFERRED EMBODIMENTS

Figure 1:
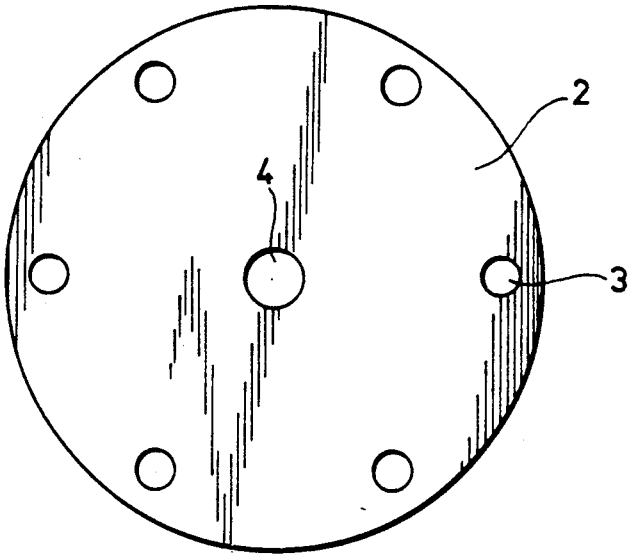
FIG. 1 shows a top-view.
Figure 2:
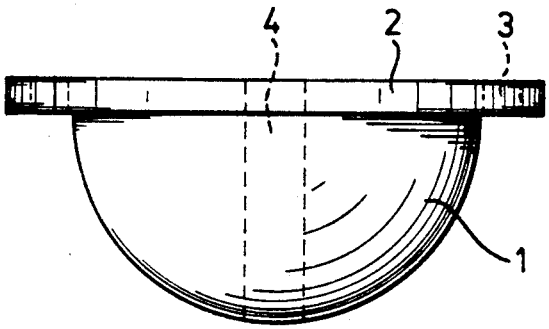
FIG. 2 shows a side-view of a soil-repression-body of the provisional road surface, according to the invention.

The rigid repression-body or base element of the embodiment according to embodiment of FIG. 1 and FIG. 2, has preferably the shape of a hemisphere 1, which is connected with its flat side to a disk-shaped junction-plate 2. This junction-plate 2 is equipped with fixation points, for example holes 3, divided over the rim of the junction-plate, while junction-plate 2 and hemisphere 1 may be provided with a coaxial cylindrical hole 4, of which the purpose will be explained further on.

The junction-plate 2 and hemisphere 1 may be one solid unit, but they may also be separate parts fixed together, as will be described further on.

The hemisphere 1 may be solid or hollow, but must be rigid. Preferably the hemisphere 1 and the junction-plate 2 are made of reinforced artificial resins, but other materials may also be used. The rigid body 1 may, instead of being a hemisphere, also have another shape, as for example a conical or pyramid shape (not shown).

The bodies 1 preferably have a diameter of approximately 0.1–0.2 meter and a height of approximately 0.05–0.15 meter. The soil-repression-bodies are placed on the ground surface in a regular mesh at a mutual distance of approximately 0.25–0.35 meter center to center, while the soil-repression-bodies are interconnected by flexible link-elements 5, which will be described further on. Those flexible link-elements 5 are attached to the fixation-points 3 of the junction-plate 2.

The bodies are pushed into the ground by the vehicles driving on the provisional road surface. As a consequence the soil beneath and in between the bodies 1 will be densified, causing an increase in effective stress in the soil and hence an increase in internal friction of the soil and consequently an increase in bearing capacity of the topsoil.

Figure 3:
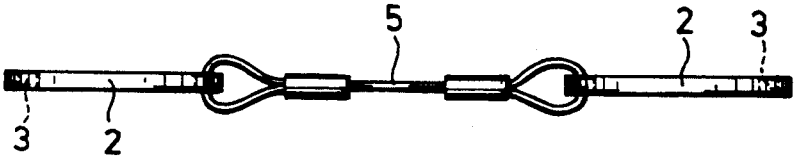
FIG. 3 and FIG. 4 show side-views of two-different types of flexible link-elements, according to the invention.
Figure 4:
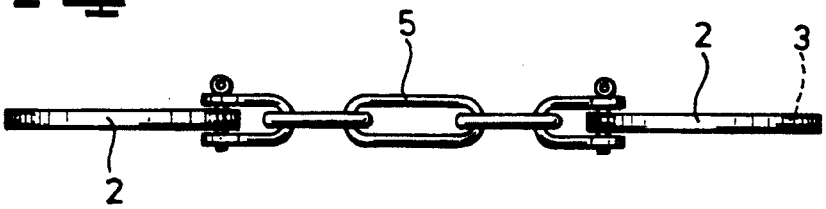
Figure 5:
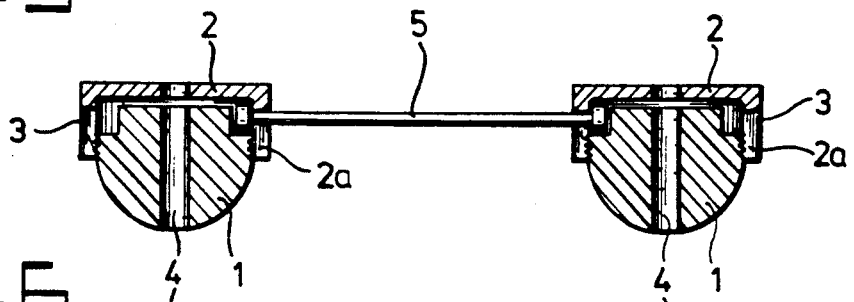
FIG. 5 shows a vertical cross-section.
Figure 6:
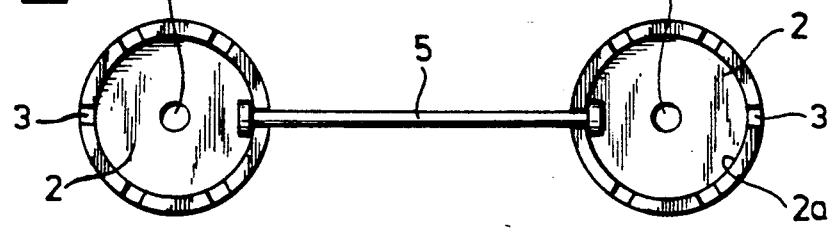
FIG. 6 shows a horizontal cross-section of another type of flexible link-element.

In FIG. 3 as flexible link-element a cable 5 is used. In FIG. 4 the flexible link-element 5 comprises chain elements. In FIG. 5 and FIG. 6 the flexible link-element 5 comprises a rod, hinged to the fixation points of the junction-plates 2.

All types of applied link-elements are resistant against pulling forces and shear forces, but not to bending moments, in other words, the junction-plates of adjacent soil-repression-bodies are linked together in a hinged and flexible way.

The bodies 1 are in fact linked together into a membrane. This membrane may consist of a woven textile, of which the warp and woof may consist of cabled or extruded artificial resin strings or steel cable strings or a combination thereof. The membrane may also be structured like a wide-mesh network, consisting of cables or strings, which are fixed together in the nodes, stress and shear resistant, directly, or indirectly by means of a junction-plate.

Figure 8:
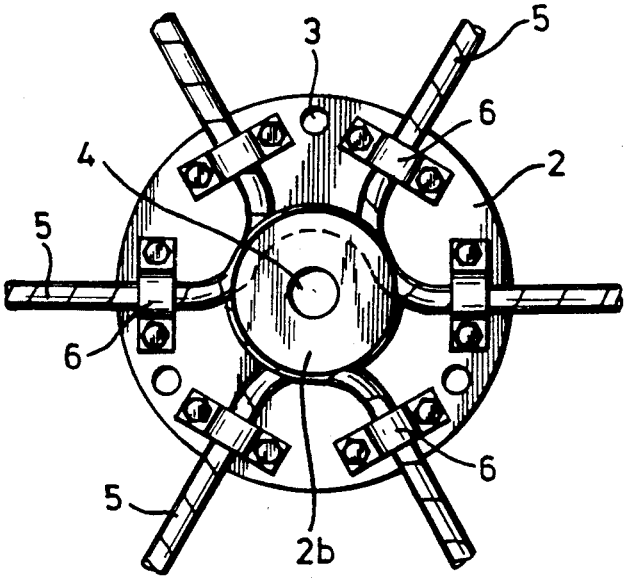

In the design of FIG. 5 and FIG. 6 the junction-plate 2 is equipped with an annular flange 2*a* which engages the periphery of the body 2 and may be screwed on it. In FIG. 8 the rigid repression-bodies are not shown.

Figure 7:
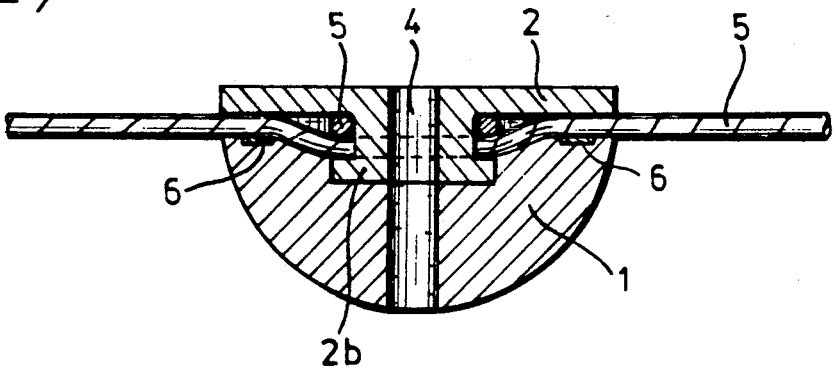
FIG. 7 and FIG. 8 show a vertical and a horizontal cross-section of another type of rigid soil-repression-body, with again another type of flexible link-element.

In FIG. 7 and FIG. 8 another design is shown, by which the flexible link-elements 5 are made of non-interrupted cables, which at the spot of the solid bodies extend to other adjacent bodies.

The cables 5 are by means of clenches 6 or the like fixed to the underside of the junction-plate 2. The junction-plate 2 comprises a hub-shaped part 2*b* around which the cable 5 is guided to a next clench 6 and then to a next rigid body.

Figure 9:
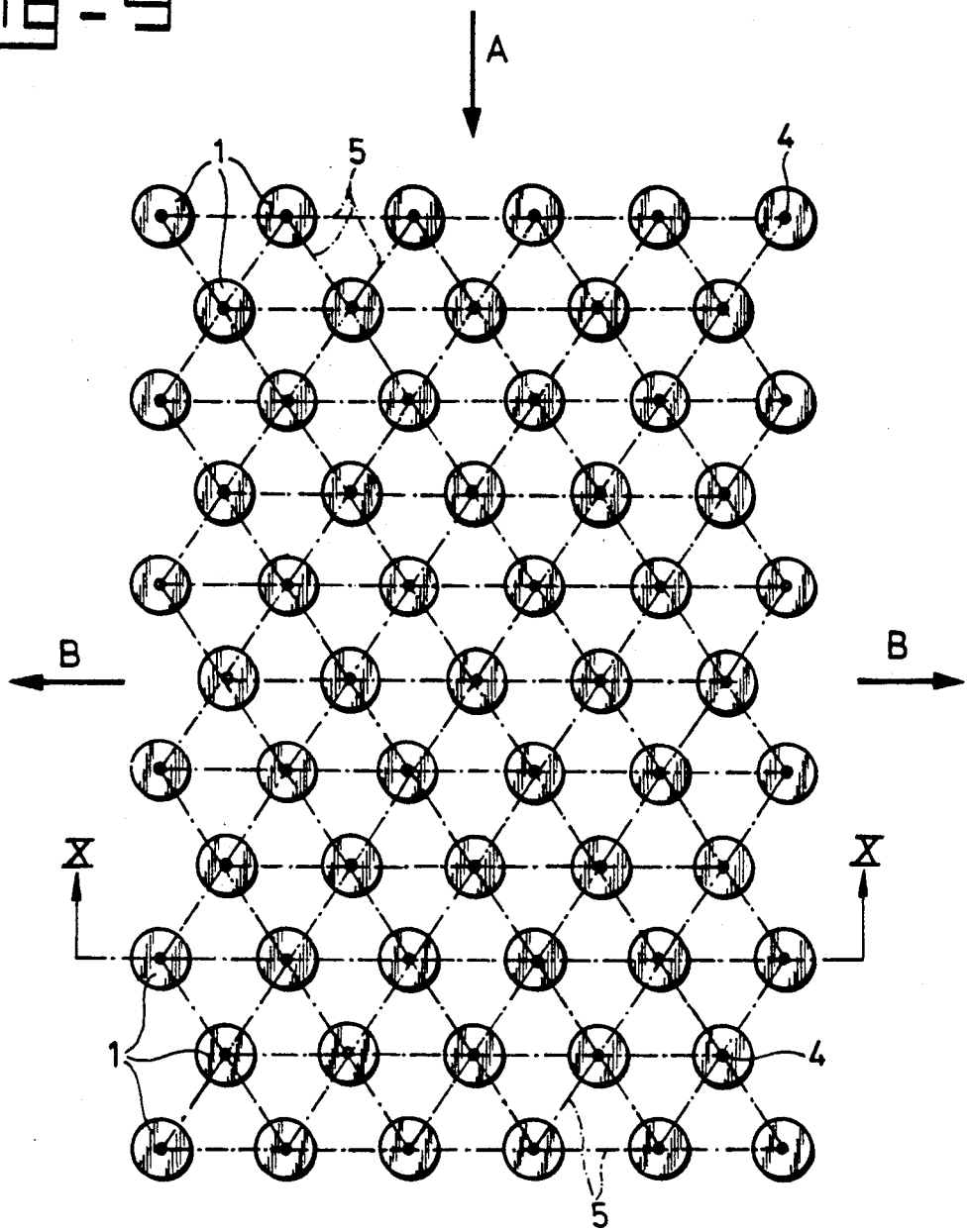
FIG. 9 shows a schematic top-view of a provisional road surface, conforming to the invention.
Figure 10:
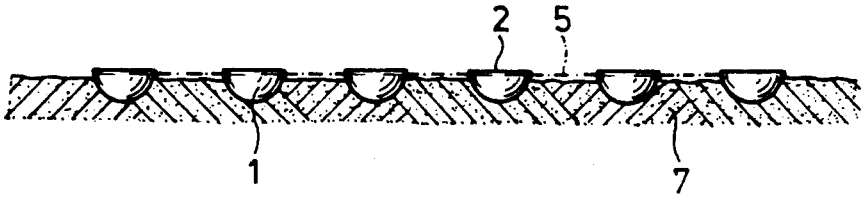
FIG. 10 shows a cross-section over the line X—X of FIG. 9.

FIG. 9 is shows a top-view of the provisional road surface, conforming to the invention, while FIG. 10 shows a cross-section on the line X—X of FIG. 9.

Figure 11:
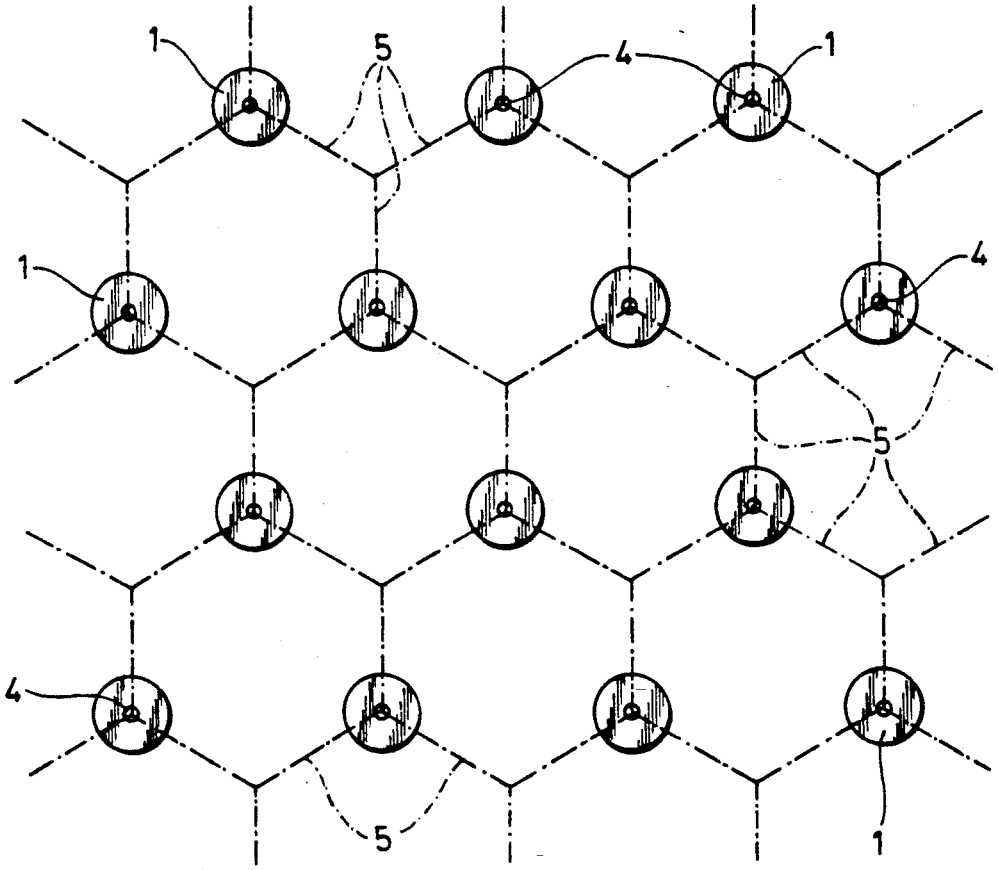
FIG. 11 shows a provisional road surface with link-elements, by which the soil-repression-bodies are placed in a hexagonal mesh.

The soil-repression-bodies are fixed into a network by means of the link-elements 5, while several patterns for the network may be used, for example in a triangular mesh as shown in FIG. 9, diamond mesh (not shown) or hexagonal mesh as shown in FIG. 11.

The direction of movement for passing vehicles on the provisional road surface is indicated by the arrow A in FIG. 9. Preferably the provisional road surface is kept under pretension in a direction perpendicular to the direction of movement, as indicated by arrows B—B in FIG. 9. By doing so, the provisional road surface is kept outstretched on the soil-surface as shown in FIG. 10. Tensioning of the provisional road surface may be induced by several means, for example due to the lateral soil resistance of the soil, acting on every consecutive soil-repression-body of the provisional road surface itself, or for example with soil-anchors fixed to the edges of the provisional road surface (not shown), or by stretching the provisional road surface between natural fixed points in the terrain, like trees.

Figure 12:
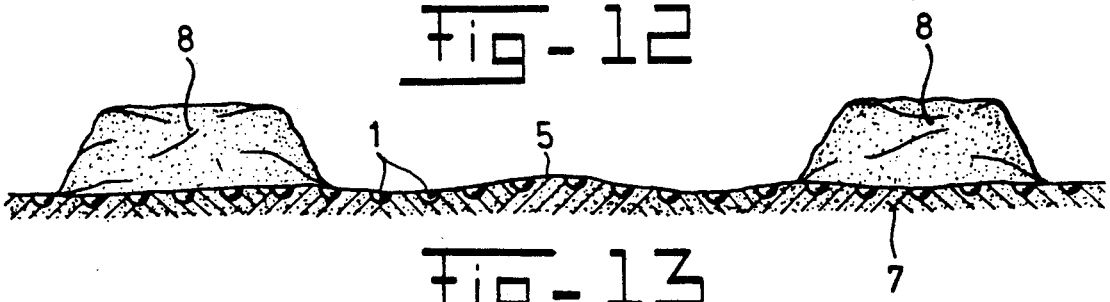
FIG. 12, FIG. 13 and FIG. 14 show possible methods for the application of pre-tension in a direction perpendicular to the direction of movement of the vehicles.
Figure 13:
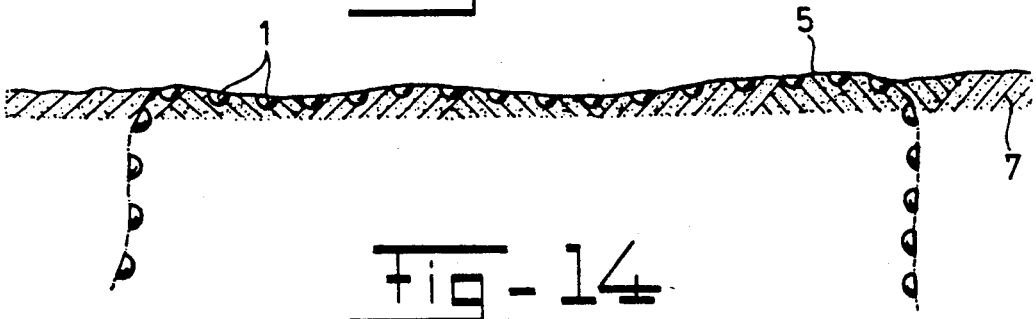

It is also possible to cover the edges of the provisional road surface with a ridge of soil 8, or by digging the edges into the soil 7, see FIG. 12 and FIG. 13.

Figure 14:
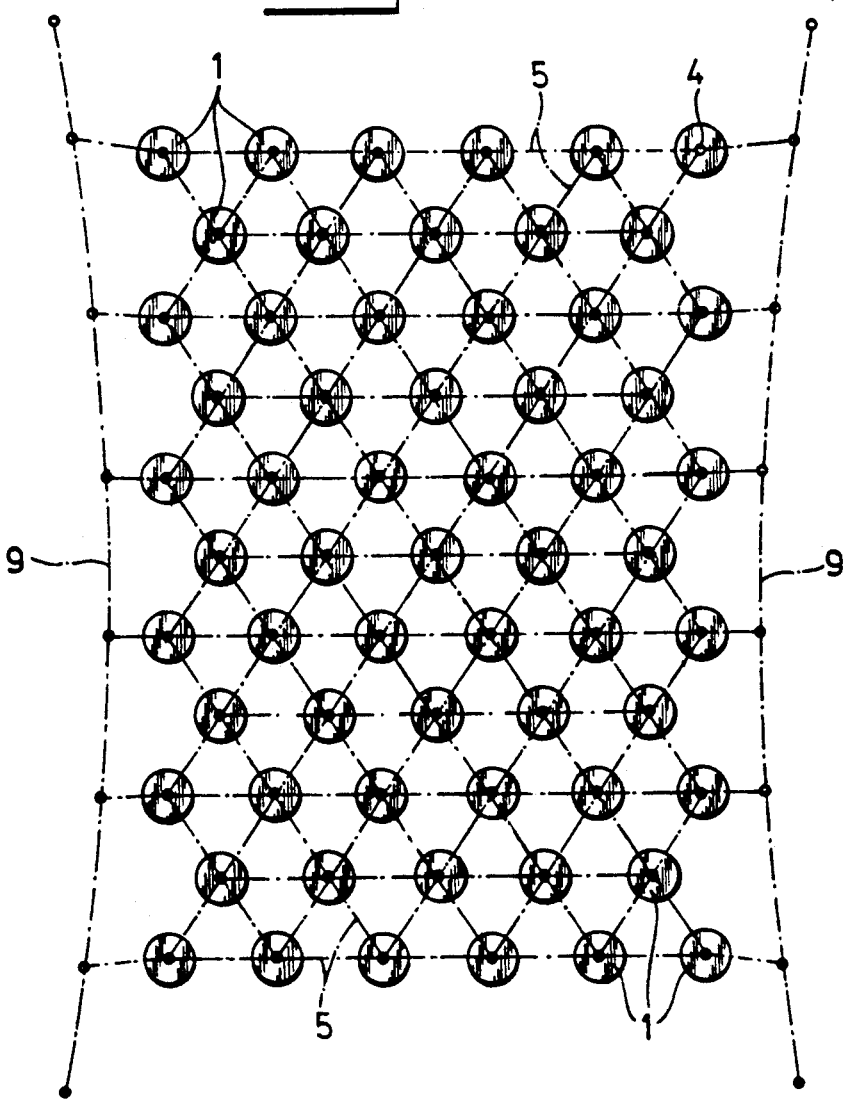

In the configuration of FIG. 14, the edges of the provisional road surface are connected to tensioned cables 9 alongside the provisional road surface. These tensioned-cables 9 may be anchored to the ground by solid metal, timber or artificial-resin pins, ground-anchors or natural fixed points like trees in the terrain.

In order to avoid over-loading of the provisional road surface, or parts thereof, endangering the rupture of one or more cables (which may cause injuries to man, or may cause material damage to vehicles), these anchor-points in the soil may be designed in such a way, that they give way or will be pulled out of the ground in case of over-loading.

Safety measures against over-loading can also be realized in the cables themselves or in the junction-plates, with known methods. It is also possible to connect the edges of the provisional road surface to the fixed points in the terrain via, for example springs, energy-dissipators without irreversible displacements (for example hydraulic or pneumatic shock-absorbers), energy-dissipators with irreversible displacements (for example metal plastic-strain absorbers), or combinations of those elements; these known elements are not shown.

If necessary metal pins can be driven into the ground through the central holes 4 of the soil-repression bodies, in order to anchor these soil-repression bodies onto the ground.

The provisional road surface can also be used in, for example, forestry ranges. The provisional road surface can easily be laid around trees and other obstacles.

The provisional road surface can also be rolled-up and as such fill-in terrain incisions or water-transporting ditches as a fascine. Due to the rigid soil-repression bodies, a voluminous and permeable fascine will be formed, when the provisional road surface is rolled-up. A good permeability is important in case water-transporting ditches in the terrain are bridged with a fascine. In case such water-transporting ditches are blocked, it may lead to (locally) high phreatic levels, worsening the bearing capacity of the terrain and therefore the mobility, or in the worst case it may cause local inundations of the surrounding terrain.

I claim:

1. A re-usable road surface, comprising: soil-repression bodies to be placed on a provisional ground surface at a mutual distance therebetween; flexible, elongated rod or rope-shaped link elements between the bodies; wherein each body is formed as a plate-shaped part having therebelow a downwardly projecting rigid repression part for penetrating the ground surface; the plate-shaped part being provided with means for connecting the plate-shaped part to the flexible link elements; whereby the bodies are arranged in substantially parallel, mutually staggered rows and each body is connected with adjacent bodies in other rows by said link elements.

2. A road surface according to claim 1, wherein the rigid repression part has a hemispherical shape, with a flat side thereof attached to the underside of the plate-shaped part.

3. A road surface according to claim 1, wherein the rigid repression part has a hemispherical shape with a base and a circular cross-section, with the base attached to the underside of the plate-shaped part.

4. A road surface according to claim 1, wherein the plate-shaped part is provided with a rim and fixation points regularly spaced over the rim for the attachment of the link elements.

5. A road surface according to claim 1, wherein the link elements extend continuously over a plurality of soil-repression bodies.

6. A road surface according to claim 1, wherein the soil-repression bodies are fixed to the ground surface in a stretched-out position.

7. A road surface according to claim 1, wherein the soil-repression bodies are designed to fill up terrain incisions or water transporting ditches.

8. A road surface according to claim 1, wherein said plate-shaped part has a circular shape.

9. A road surface according to claim 1, wherein each plate-shaped part has greater than one link element affixed thereto, with each link element extending between at least two plate-shaped parts.

10. A road surface according to claim 1, wherein a plurality of said bodies form a network thereof connected together by said link elements and spaced part with exposed ground surface therebetween.

* * * * *